US009341047B2

(12) United States Patent
Turick et al.

(10) Patent No.: US 9,341,047 B2
(45) Date of Patent: May 17, 2016

(54) ACTUATION LOCKOUT SYSTEM

(71) Applicants: Daniel J. Turick, Houston, TX (US); Kevin J. Berry, Houston, TX (US); Jamie L. Imhoff, Houston, TX (US); Anthony Thomas, Houston, TX (US)

(72) Inventors: Daniel J. Turick, Houston, TX (US); Kevin J. Berry, Houston, TX (US); Jamie L. Imhoff, Houston, TX (US); Anthony Thomas, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 646 days.

(21) Appl. No.: 13/727,879

(22) Filed: Dec. 27, 2012

(65) Prior Publication Data

US 2013/0233565 A1 Sep. 12, 2013

Related U.S. Application Data

(60) Provisional application No. 61/609,676, filed on Mar. 12, 2012.

(51) Int. Cl.

| | |
|---|---|
| ***E21B 34/14*** | (2006.01) |
| ***E21B 34/10*** | (2006.01) |
| *E21B 34/00* | (2006.01) |

(52) U.S. Cl.

CPC ..... *E21B 34/14* (2013.01); *E21B 34/103* (2013.01); *E21B 2034/007* (2013.01)

(58) Field of Classification Search

CPC ..... E21B 2034/007; E21B 34/102; E21B 34/103; E21B 34/14; F16K 1/123; F16K 1/34

See application file for complete search history.

(56) References Cited

U.S. PATENT DOCUMENTS

| | | | | |
|---|---|---|---|---|
| 4,003,434 | A * | 1/1977 | Garrett | E21B 33/043 166/120 |
| 4,928,772 | A * | 5/1990 | Hopmann | 166/386 |
| 5,263,683 | A | 11/1993 | Wong | |
| 5,305,833 | A | 4/1994 | Collins | |
| 6,189,619 | B1 | 2/2001 | Wyatt et al. | |
| 6,516,890 | B1 * | 2/2003 | Jackson | E21B 34/102 166/181 |
| 6,722,440 | B2 | 4/2004 | Turner et al. | |
| 7,325,617 | B2 * | 2/2008 | Murray | 166/376 |
| 2002/0096878 | A1 * | 7/2002 | DeBerry et al. | 285/123.4 |
| 2004/0000406 | A1 | 1/2004 | Allamon et al. | |
| 2006/0124310 | A1 | 6/2006 | Lopez de Cardenas et al. | |
| 2006/0283791 | A1 * | 12/2006 | Ross | 210/429 |
| 2009/0266556 | A1 * | 10/2009 | Swenson et al. | 166/373 |
| 2011/0030968 | A1 * | 2/2011 | Xu | 166/373 |
| 2011/0042107 | A1 * | 2/2011 | Chambers et al. | 166/386 |
| 2011/0048742 | A1 | 3/2011 | Smith et al. | |

OTHER PUBLICATIONS

Schlumberger, [online]; [retrieved on Jan. 31, 2013]; retrieved from the Internet http://www.slb.com/~/media/Files/production/brochures/wireline_cased_hole/resolve/resolve_brochure.pdf; "Resolve"; Copyright 2012 Schlumberger ; 26 pages. International Search Report and Written Opinion; International Filing Date: Feb. 6, 2013; Date of Mailing May 10, 2013; 11 pages.

* cited by examiner

*Primary Examiner* — Robert E Fuller
*Assistant Examiner* — Christopher Sebesta
(74) *Attorney, Agent, or Firm* — Cantor Colburn LLP

(57) ABSTRACT

An actuation system, including a first member having a first profile engagable with a tool operatively arranged for actuating the member from an initial configuration to an actuated configuration. A second member is included that is movable relative to the first member. The second member has a lockout feature configured to prevent engagement of the first member with the tool while the second member is located proximate to the first member. A method of selectively actuating a system is also included.

20 Claims, 3 Drawing Sheets

ACTUATION LOCKOUT SYSTEM

CROSS REFERENCE TO RELATED APPLICATIONG

This application claims the benefit of an earlier filing date from U.S. Provisional Application Ser. No. 61/609,676 filed Mar. 12, 2012, the entire disclosure of which is incorporated herein by reference.

BACKGROUND

The downhole drilling and completions industry utilizes a variety of components, packers, sleeves, valves, anchors, etc. that must be shifted, moved, or actuated. One type of actuation system includes a shifting tool having a profile that is complementarily formed with respect to a profile of a component to be actuated, e.g., a sleeve. By simply running the shifting tool by the component to be actuated, the profiles automatically engage and the shifting tool is able to cause actuation of the component. While this type of system works and is used extensively in downhole systems, it is not without limitations. For example, a delay is sometimes desired between when a string including a shifting tool is run and when a downhole component is desired to be actuated, e.g., so additional operations can be performed downhole or at surface before actuation occurs. Accordingly, apparatuses to effect such delay would be well received by the art.

SUMMARY

An actuation system, including a first member having a first profile engagable with a tool operatively arranged for actuating the member from an initial configuration to an actuated configuration and a second member movable relative to the first member, the second member having a lockout feature configured to prevent engagement of the first member with the tool while the second member is located proximate to the first member.

A method of selectively actuating a system, the system having a first member with a profile that is engagable with a tool operatively arranged for actuating the first member from an initial configuration to an actuated configuration, the method including positioning a lockout feature of a second member proximate to the profile of the first member; and preventing engagement between the first member and the tool with the lockout feature.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
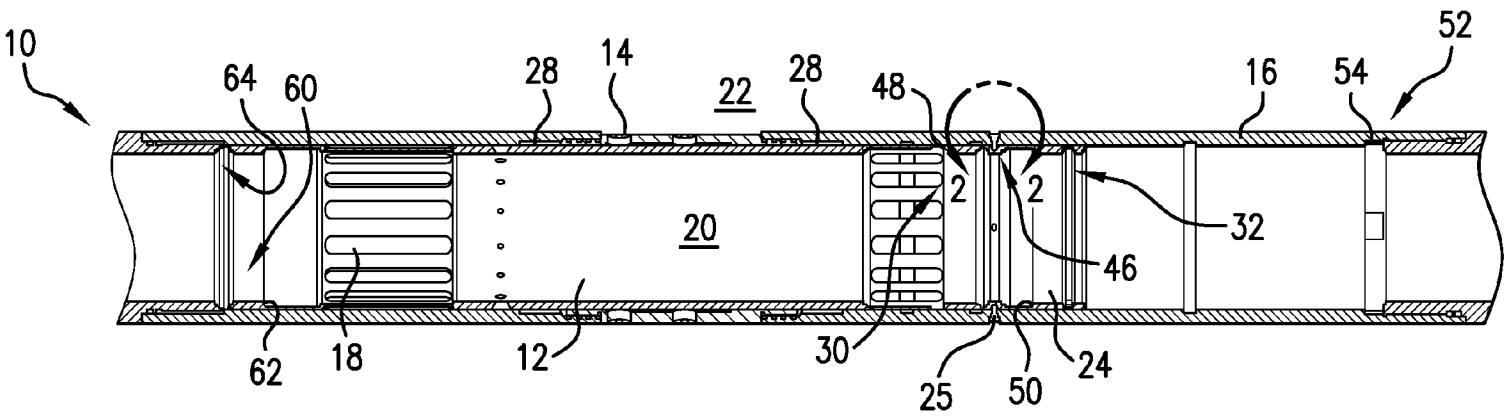
FIG. 1 is a cross-sectional view of an actuation system having both a port control sleeve and a lockout sleeve in an initial or closed position.

Referring now to the drawings, a system 10 is shown in FIG. 1. The system 10 includes a sleeve 12 for opening one or more ports 14 in a housing 16. Specifically, the sleeve 12 includes slots or openings 18 that are axially alignable with the ports 14 by shifting or moving the sleeve 12, thereby enabling fluid communication between an interior fluid pathway 20 in the string 16 and an exterior area 22, e.g., an annulus, a formation, a reservoir, etc., external to the string 16. In one embodiment, opening the ports 14 with the sleeve 12 enables fluid production, e.g., hydrocarbon production. It will be appreciated, particularly in view of the below description, that other shiftable, actuatable, or movable members or tools could be utilized in lieu of the sleeve 12 for enabling fluid communication for other purposes, or for performing, or assisting in the performance of, operations other than opening ports and/or enabling fluid communication, e.g., setting a seal, packer, or anchor, actuating a tool, etc. Thus, while the particular operation of the system 10 is given herein as an example, it is understood that the sleeve 12 could be replaced by other actuatable or shiftable members and that actuation thereof could be for other purposes than opening the ports 14.

Initially, i.e., during run-in of the system 10, the sleeve 12 is held in the closed position (as shown in FIG. 1) by a lockout sleeve 24. As described in more detail below, the lockout sleeve 24 ensures that premature opening of the ports 14 and/or actuation of the sleeve 12 does not occur, and further enables a delay between when a shifting tool is run and when the ports 14 are opened. For example, in some downhole fluid production systems it is common to run a production string having a shifting tool thereon for actuating a plurality of tools or members (e.g., for opening a plurality of the sleeves 12 for opening a plurality of sets of the ports 14). Operators of such downhole fluid production systems may desire a delay between when the production string is initially run and when fluid production begins in order to perform additional operations at surface or downhole, e.g., in preparation of or to assist in production.

Figure 2:
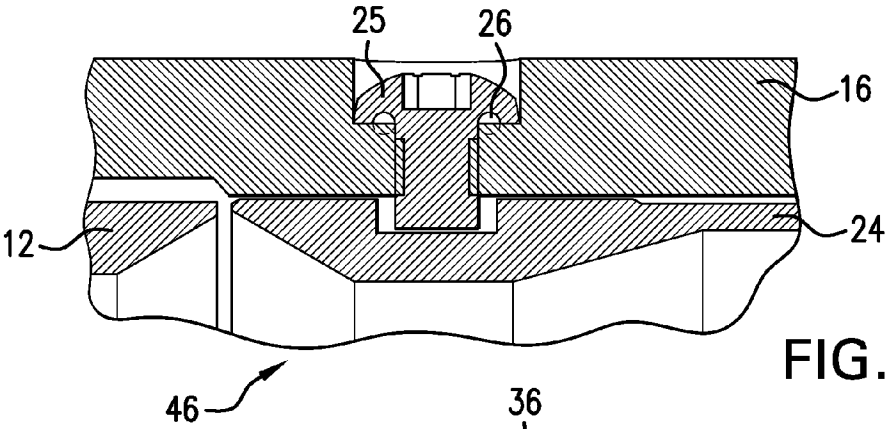
FIG. 2 is an enlarged view of the area 2-2 encircled in FIG. 1.

The lockout sleeve 24 is secured to the housing 16 via a release member 25. The release member 25 is shown in more detail in FIG. 2 taking the form of a shear screw. In FIG. 2 it can also be seen that the release member 25 is equipped with a seal element 26, e.g., an o-ring or the like, for preventing fluid communication between the internal and external areas 20 and 22. In other embodiments, the release member 25 can take the form of any other member that releases under a sufficient load or pressure, e.g., a collet, shear ring, etc. If so desired, the release member 25 could be released due to other stimuli, such as exposure to a fluid (causing degradation, corrosion, dissolution, etc.), a digital or analog signal, electric current, a magnetic field, hydraulic pressure, etc. Also to prevent fluid communication between the areas 20 and 22 before the sleeve 12 has been shifted, the system 10 includes a set of packing assemblies 28 on opposite sides of the ports 14 and radially between the sleeve 12 and the housing 16.

Figure 3:
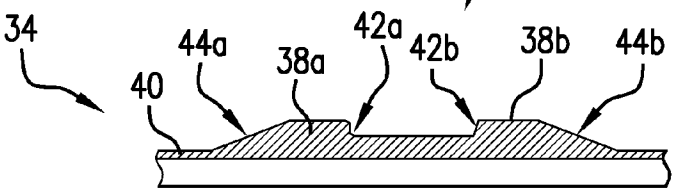
FIG. 3 is a cross-sectional of a profile of a shifting tool.

To this end, the sleeve 12 includes a profile 30 and the lockout sleeve 24 includes a profile 32, with each profile 30, 32 enabling its respective one of the sleeves 12, 24 to be shifted or actuated by a complementarily shaped shifting tool. While shifting tools are well known in the art, a shifting tool 34 is generally shown in FIG. 3 for the purpose of discussion. The shifting tool 34 includes a shifting profile 36 having a first projection 38*a* for enabling shifting of a corresponding tool, sleeve, or member in a first direction, and a second projection 38*b* for enabling shifting in a second direction. The profile 36 is formed, e.g., on each of a plurality of collet fingers or other radially flexible members 40. Each of the first and second projections 38*a*, 38*b* include an engagement surface 42*a*, 42*b* and a disengagement surface 44*a*, 44*b* according to known shifting tool profiles (i.e., one of the surfaces 42*a*, 42*b* matingly engaging a corresponding surface of a tool or member to be actuated and one of the disengagement surfaces 44*a*, 44*b* "climbing" a corresponding disengagement surface or shoulder for radially flexing the fingers 40 and disengaging the surface 42*a*, 42*b*). Operation of the system 10 is described herebelow with respect to the tool 34, although it is to again be appreciated that other shifting tools could be used in lieu of or substituted for the tool 34 and the following example is given for the purpose of discussion only.

FIG. 1 depicts the system 10 in its initially closed position, e.g., after the housing 16 is run downhole and positioned in a desired location, such as proximate to a fluid producing zone, reservoir, or formation as depicted by the numeral 22. In this initial configuration the lockout sleeve 24 is abutting, adjacent, or proximate to the sleeve 12. The lockout sleeve 24 includes a lockout feature 46 that prevents the sleeve 12 from engaging a corresponding shifting tool as long as the lockout sleeve 24 is in the initial configuration shown in FIG. 1. That is, the feature 46 is positioned near the profile 30 so that the feature 46 essentially acts as part of the profile 30, at least from the perspective of a shifting tool. Alternatively stated, the feature 46 alters or modifies the geometry of the profile 30, or at least how a shifting tool "sees" the geometry of the profile 30, which prevents the shifting tool from engaging with the profile 30 of the sleeve 12. For example, the profile 30 includes a surface 48 arranged for engagement with a corresponding surface of a shifting tool, e.g., the surface 42*a* of the shifting tool 34. By positioning the feature 46 properly, the shifting tool will be unable to engage with the surface 48 of profile 30. For example, again with respect to the shifting tool 34, the feature 46 can be axially spaced from the surface 48 in the initial configuration so that the feature 46 is axially aligned with the projection 38*b* when the surface 42*a* is aligned with the surface 48. In this way, the feature 46 will interact with the projection 38*b* and cause the finger 40 to radially flex inwardly, thereby maintaining disengagement of the shifting tool 34 and the sleeve 12. It is to be appreciated that the feature 46 could take forms other than the one shown, e.g., extending axially, radially, circumferentially, etc. as long as the feature 46 changes, alters, or modifies the geometry of the profile 30, or how shifting tools "see", engage, or interact with the profile 30.

Figure 4:
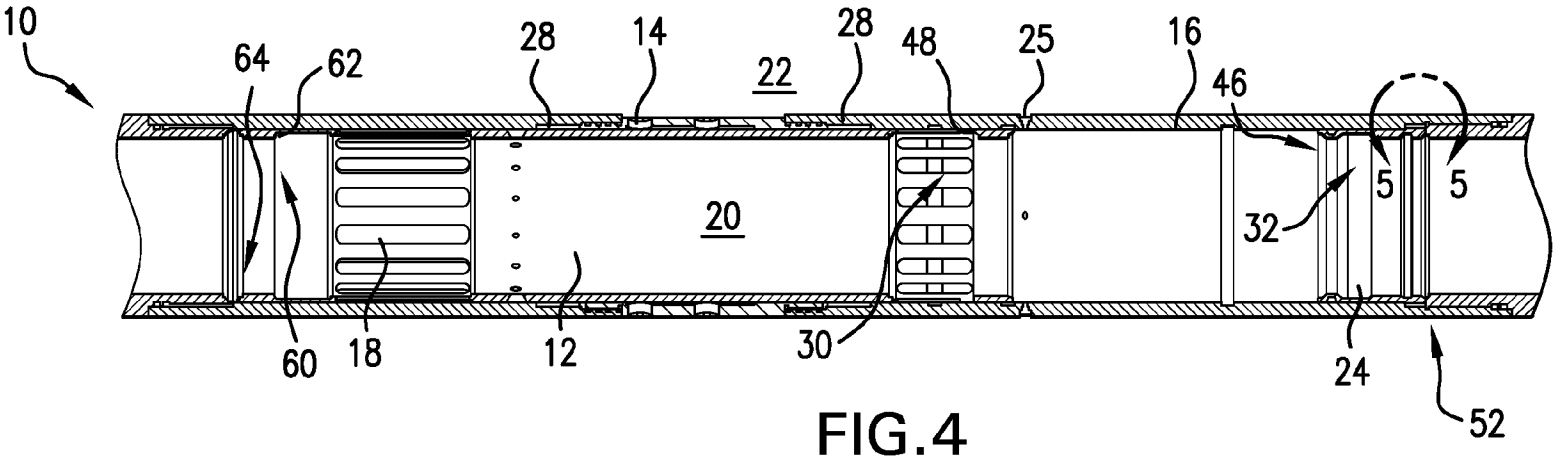
FIG. 4 is a cross-sectional view of the actuation system of FIG. 1 with the lockout sleeve shifted away from the port control sleeve.
Figure 5:
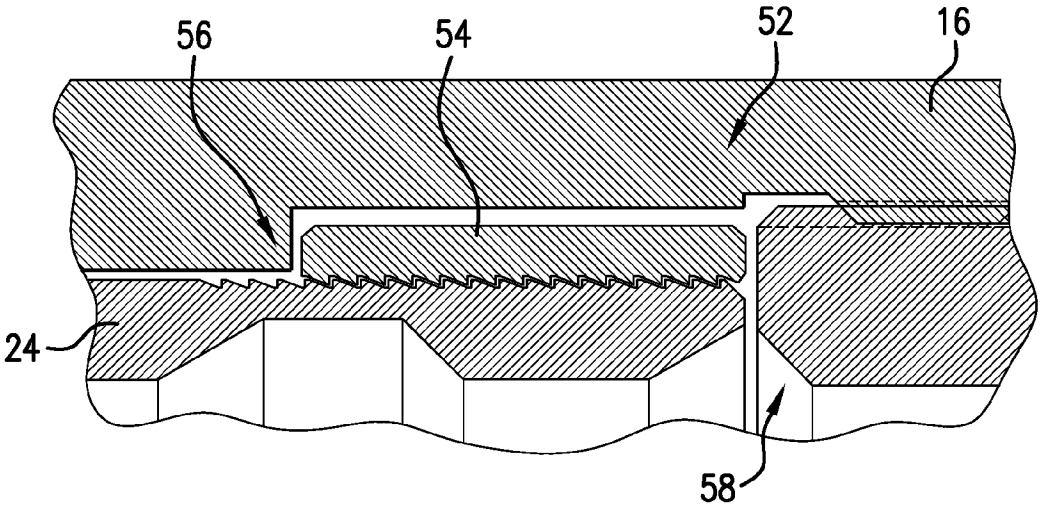
FIG. 5 is an enlarged view of the area 5-5 encircled in FIG. 4.

The profile 32 of the lockout sleeve 24 is not similarly blocked by a lockout feature, and will engage a shifting tool, e.g., by mating engagement between the surface 42*a* of the shifting tool 34 and a surface 50 of the profile 32. Once a suitable force or other stimuli has been achieved for releasing the release member 25, e.g., a force sufficient to shear a shear screw, the lockout sleeve 24 is shifted away from the sleeve 12 to the configuration shown in FIG. 4. As seen in FIG. 4, the sleeve 12 remains in its closed or non-actuated position even after shifting of the lockout sleeve 24. The system 10 includes a locking mechanism 52 for holding the lockout sleeve 24 in its shifted position. For example, as shown more clearly in FIG. 5, the locking mechanism 52 is formed from a body lock ring 54, with the lockout sleeve 24 and the body lock ring 54 having a ratchet engagement 56 therebetween formed from complementarily formed ratcheting teeth or grooves. It is to be noted that instead of a separate lock ring, the ratchet teeth or grooves could be formed directly in a surface of the housing 16. The ratchet engagement 56 enables relative movement between the body lock ring 54 and the lockout sleeve 24 in one direction only, i.e., away from the sleeve 12. Other locking mechanisms could be included, e.g., a split ring, dogs, etc. that spring or move partially radially outwardly into a corresponding recess in the housing 16 for prohibiting relative movement between the lockout sleeve 24 and the housing 16.

The shifting tool used for shifting the lockout sleeve 24, e.g., the shifting tool 34, can be released from the lockout sleeve 24 by use of a shoulder 58 of the housing 16, e.g., by the disengagement surface 44*b* of the tool 34 "climbing" the shoulder 58 and flexing the finger 40 radially inwardly for disengaging the surfaces 42*a* and 50. As a result, once the lockout sleeve 24 has been fully shifted away from the sleeve 12, the lockout sleeve 24 becomes locked by the locking mechanism 52 and is not engagable with shifting tools due to the presence of the shoulder 58 for the remaining life of the system 10. In this way, the lockout sleeve 24 can no longer interfere with or influence the operation of the sleeve 12, i.e., alter or modify the profile 30.

Figure 6:
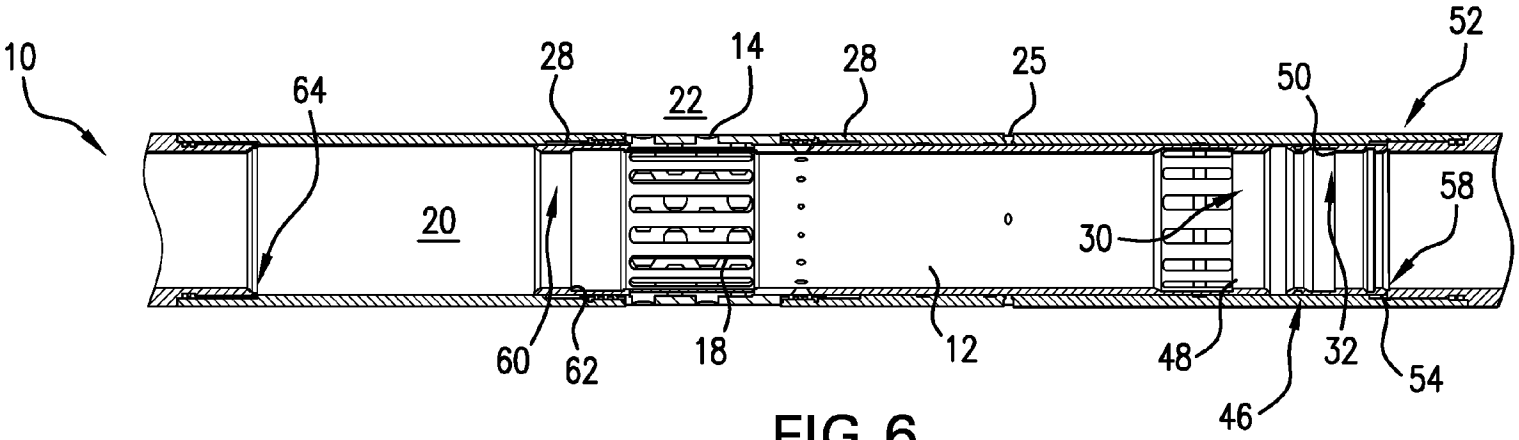
FIG. 6 is a cross-sectional view of the actuation system of FIG. 1 with the port control sleeve shifted to an open position.
Figure 7:
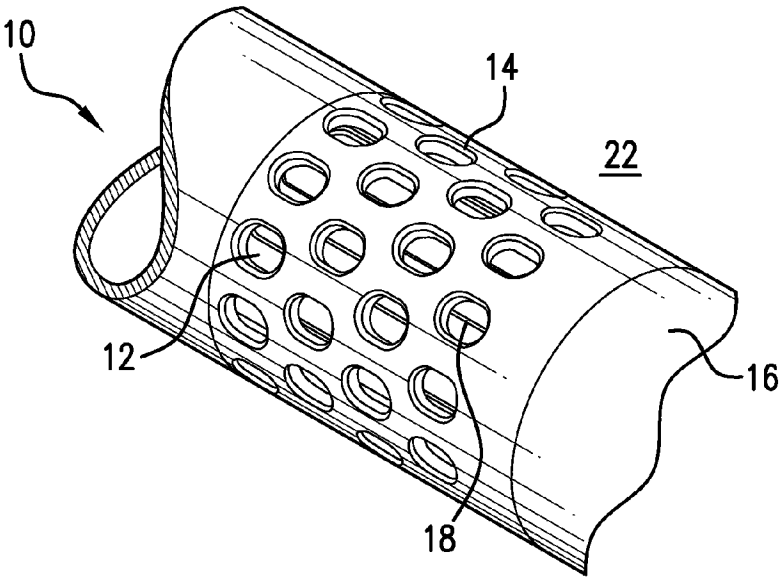
FIG. 7 is a perspective view showing a plurality of ports aligned with openings in the port control sleeve when the port control sleeve is in the open position.

As a result of moving the lockout sleeve 24, more particularly the lockout feature 46, away from the sleeve 12, the sleeve 12 becomes engagable by its corresponding shifting tool. For example, again with reference to the shifting tool 34, the surfaces 48 and 42*a* become engagable when the lockout feature 46 is absent, as the fingers 40 of the tool are not flexed radially inwardly, thereby enabling the tool 34 to actuate the sleeve 12 to its open position or configuration as shown in FIGS. 6 and 7. It is to be appreciated that the shifting tool used for shifting the sleeve 12 could be the same shifting tool used to actuate the lockout sleeve 24, or a different shifting tool.

In one embodiment, once the lockout sleeve 34 has been displaced the sleeve 12 is arranged to be opened and closed repeatedly. That is, in addition to the profile 30, the sleeve 12 includes another profile 60 arranged for enabling a shifting tool to close the sleeve 12. For example, again referring to the shifting tool 34, the engagement surface 42*b* of the shifting tool 34 can be matingly engaged with a surface 62 of the sleeve 12 for enabling the sleeve 12 to be closed. Once closed, the shifting tool 34 can be released from the sleeve 12 by engagement of the disengagement surface 44*a* with a shoulder 64 of the housing 16.

It is again noted that sleeves or valves for enabling fluid communication for purposes other than production can be similarly controlled. Additionally, other tools that are settable or actuatable by shifting tools such as seals, packers, anchors, locking mechanisms, etc. could be substituted for the sleeve 12 and the sleeve 12 is given as one example only. Furthermore, the actuatable or shiftable member does not need to be tubular in nature, and could have some other cross-section or take some other shape as desired or dictated by the particular environment or geometry in or with which a system according to the current invention is utilized.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An actuation system for use in a downhole tool, comprising:

a downhole housing comprising a first member and a second member, the first member having a first profile shape responsive selectively to a tool having a negative of the first profile shape, the tool operatively arranged for actuating the first member from an initial configuration to an actuated configuration; and the second member movable relative to the first member, the second member having a lockout feature configured to prevent engagement of the first profile with the tool while the second member is located proximate to the first member.

2. The system of claim 1, wherein the second member has a second profile engagable with the tool or another tool for enabling the second member to be moved away from first member.

3. The system of claim 1, wherein the lockout feature includes a radial protrusion operatively arranged to prevent engagement of the first profile with one or more fingers of a tool run through the system.

4. The system of claim 1, wherein the second member is initially held proximate to the first member by a release member.

5. The system of claim 4, wherein the release member is a shear screw.

6. The system of claim 1, further comprising a locking mechanism for holding the second member in a position away from the first member.

7. The system of claim 6, wherein the locking mechanism is a lock ring.

8. The system of 6, wherein the locking mechanism forms a ratchet engagement with the second member.

9. The system of claim 1, wherein the first and second members are sleeves.

10. The system of claim 1, wherein movement of the first member to the actuated configuration opens one or more ports.

11. The system of claim 1, wherein the first member includes a second profile for enabling the first member to be moved by the tool from the actuated configuration to the initial configuration.

12. The system of claim 1, wherein the second member has a second profile operatively enagagable with the tool for enabling the tool to move the second member away from the first member.

13. A method of selectively actuating a system in a downhole tool, the system having a downhole housing comprising a first member and a second member, the first member having a profile that is engagable with a tool having a negative shape of the profile operatively arranged for actuating the first member from an initial configuration to an actuated configuration, the method comprising:

positioning a lockout feature of the second member proximate to the profile of the first member; and preventing engagement between the first member and the tool with the lockout feature.

14. The method of claim 13, further comprising moving the second member away from the first member for enabling engagement between the first member and the tool.

15. The method of claim 14, wherein the second member includes a second profile that is engagable with the tool for moving the second member.

16. The method of claim 15, further comprising actuating the first member from the initial configuration to the actuated configuration.

17. The method of claim 15, wherein actuating the first member from the initial configuration to the actuated configuration includes opening one or more ports.

18. The method of claim 14, further comprising holding the second member in a position away from the first member with a locking mechanism after moving the second member away from the first member.

19. The method of claim 18, wherein holding the second member in the position away from the first member includes forming a ratchet engagement with the second member.

20. The method of claim 14, wherein the first member is repeatedly transitioned by the tool between the initial configuration and the actuated configuration after moving the second member away from the first member.

* * * * *